US009248352B1

(12) United States Patent
Patten

(10) Patent No.: US 9,248,352 B1
(45) Date of Patent: Feb. 2, 2016

(54) VISUAL ADJUSTABLE ALIGNMENT SYSTEM

(71) Applicant: Richard L. Patten, Minneapolis, MN (US)

(72) Inventor: Richard L. Patten, Minneapolis, MN (US)

( * ) Notice: Subject to any disclaimer, the term of this patent is extended or adjusted under 35 U.S.C. 154(b) by 0 days.

(21) Appl. No.: 14/745,392

(22) Filed: Jun. 20, 2015

(51) Int. Cl.
*A63B 69/36* (2006.01)
*A63B 53/04* (2015.01)
*A63B 53/06* (2015.01)
*A63B 53/00* (2015.01)

(52) U.S. Cl.
CPC ..... *A63B 53/065* (2013.01); *A63B 53/007* (2013.01); *A63B 2053/0441* (2013.01)

(58) Field of Classification Search
CPC ..... A63B 69/3685; A63B 2053/0441; A63B 53/065; A63B 53/007
USPC ..... 473/219–256, 326, 340–341
See application file for complete search history.

(56) References Cited

U.S. PATENT DOCUMENTS 3,019,022 A * 1/1962 Ehmke ..... A63B 69/3685 33/263
3,240,497 A * 3/1966 Taylor ..... A63B 49/06 473/241
3,979,125 A * 9/1976 Lancellotti ..... A63B 53/0487 473/233
4,439,928 A * 4/1984 Shoemaker, Jr. ..... B43L 9/04 33/488
4,458,900 A * 7/1984 Antonious ..... A63B 53/0487 473/254
5,082,277 A * 1/1992 Gingold ..... A63B 53/0487 473/250
5,132,844 A * 7/1992 Sharp, Jr. ..... G02B 27/08 359/617
5,160,142 A * 11/1992 Marshall ..... A63B 69/3685 473/241
5,209,470 A * 5/1993 Cimaroli ..... A63B 69/3685 33/379
5,489,097 A * 2/1996 Simmons ..... A63B 53/0487 473/326
6,558,268 B2 * 5/2003 Tindale ..... A63B 53/0487 473/244
7,070,515 B1 * 7/2006 Liu ..... A63B 53/065 473/251
7,758,439 B2 * 7/2010 Roenick ..... A63B 53/0487 473/238
7,771,284 B1 * 8/2010 Brown ..... A63B 69/3688 473/220
7,905,792 B1 * 3/2011 Stites ..... A63B 53/0487 473/238
2005/0227783 A1 * 10/2005 Olsavsky ..... A63B 53/0487 473/340

* cited by examiner

*Primary Examiner* — Sebastiano Passaniti
(74) *Attorney, Agent, or Firm* — Dave Alan Lingbeck

(57) ABSTRACT

A visual adjustable alignment system for adapting the alignment device according to the particular user. The visual adjustable alignment system includes an implement member for performing a task, an adjustment assembly in communication with the implement member and an alignment member pivotably supported by the adjustment assembly for aligning the implement member relative to an object.

8 Claims, 3 Drawing Sheets

VISUAL ADJUSTABLE ALIGNMENT SYSTEM

BACKGROUND OF THE INVENTION

1. Field of the Invention

The present invention relates to alignment tools and more particularly pertains to a new visual adjustable alignment system adapting the alignment device according to the particular user.

2. Description of the Prior Art

The use of alignment tools is known in the prior art. More specifically, alignment tools heretofore devised and utilized are known to consist basically of familiar, expected and obvious structural configurations, notwithstanding the myriad of designs encompassed by the crowded prior an which have been developed for the fulfillment of countless objectives and requirements.

The prior art includes a putter body having an outer putter face including a centrally disposed optimum contact point on one side thereof to strike a golf ball when putting and a visual alignment means formed on the side opposite the putter face, the visual alignment means including a visual alignment base to support an adjustable alignment element movably positioned thereon in operative disposition relative to the optimum contact point to selectively align the adjustable alignment element on a virtual intended or target line. Another prior an includes a putter head having a forward-facing striking surface, a heel, a toe, a top surface and a rear alignment section. The rear alignment section comprises one or more elongated indicator bars of uniform width that project backwards and that are arranged perpendicularly to the striking surface at a first upper level. Arranged at a second, lower level is a corresponding number of elongated warning strips of a contrasting color, each warning strip having approximately the same width as, and being arranged in vertical alignment with, its corresponding elongated indicator bar. While these devices fulfill their respective, particular objectives and requirements, the aforementioned patents do not disclose a new visual adjustable alignment system.

SUMMARY OF THE INVENTION

The general purpose of the present invention, which will be described subsequently in greater detail, is to provide a new visual adjustable alignment system which has many of the advantages of the alignment tools mentioned heretofore and many novel features that result in a new visual adjustable alignment system which is not anticipated, rendered obvious, suggested, or even implied by any of the prior art alignment tools, either alone or in any combination thereof. The present invention includes an implement member for performing a task, an adjustment assembly in communication with the implement member and an alignment member pivotably supported by the adjustment assembly for aligning the implement member relative to an object. None of the prior art includes the combination of the elements of the present invention.

There has thus been outlined, rather broadly, the more important features of the visual adjustable alignment system in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new visual adjustable alignment system which has many of the advantages of the alignment tools mentioned heretofore and many novel features that result in a new visual adjustable alignment system which is not anticipated, rendered obvious, suggested, or even implied by any of the prior art alignment tools, either alone or in any combination thereof.

Still another object of the present invention is to provide a new visual adjustable alignment system for adapting the alignment device according to the particular user.

Still yet another object of the present invention is to provide a new visual adjustable alignment system that can be adjusted to fit how the user views or sets the line of the alignment device in relationship to the target.

Even still another object of the present invention is to provide a new visual adjustable alignment system for golfers, in particular, depending upon how they align the face of the putter head relative to the target and whether they look directly down upon the alignment member or whether they view the alignment member at an angle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
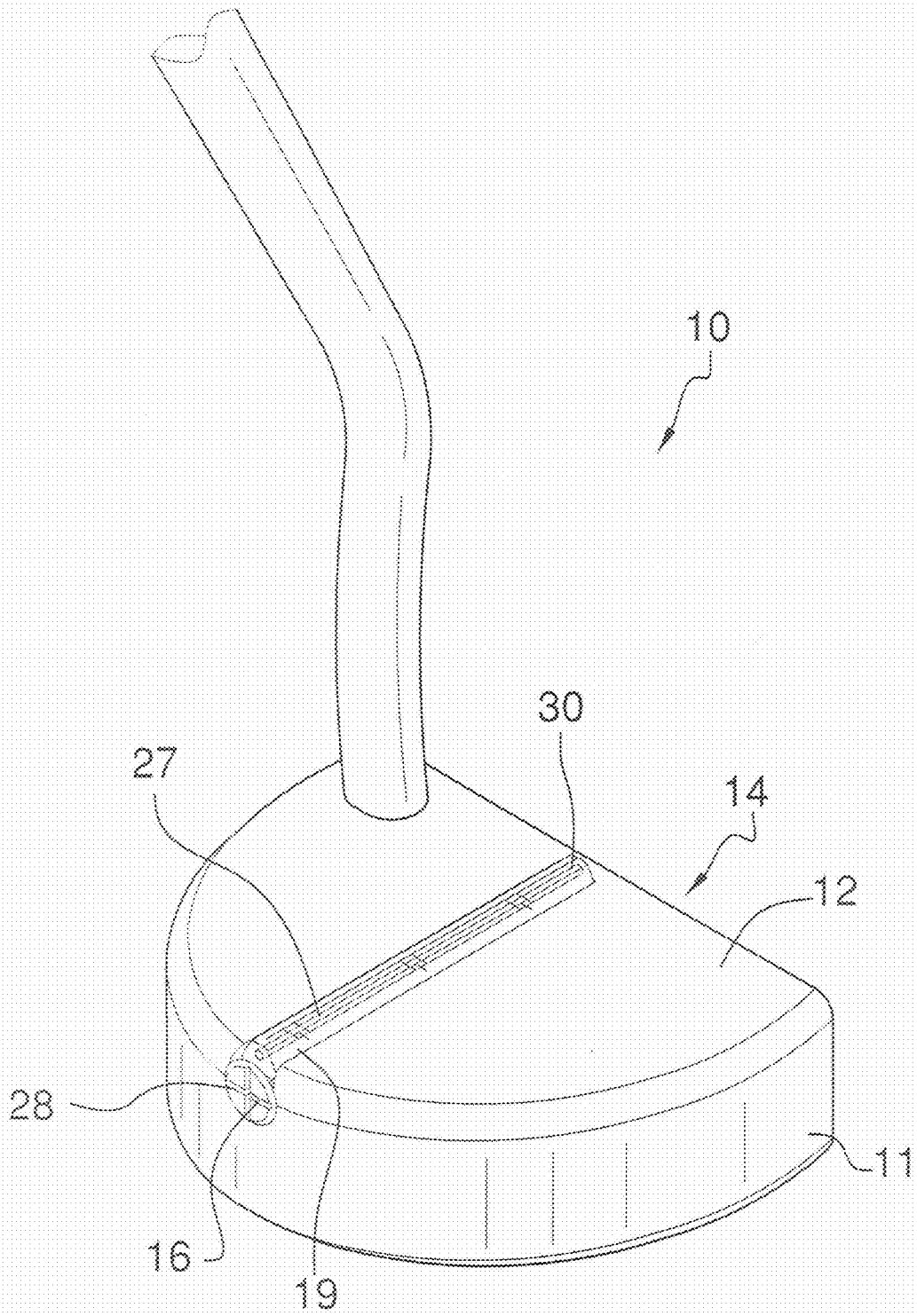
FIG. 1 is a top rear perspective view of the putter with the adjustable sight line according to the present invention.
Figure 2:
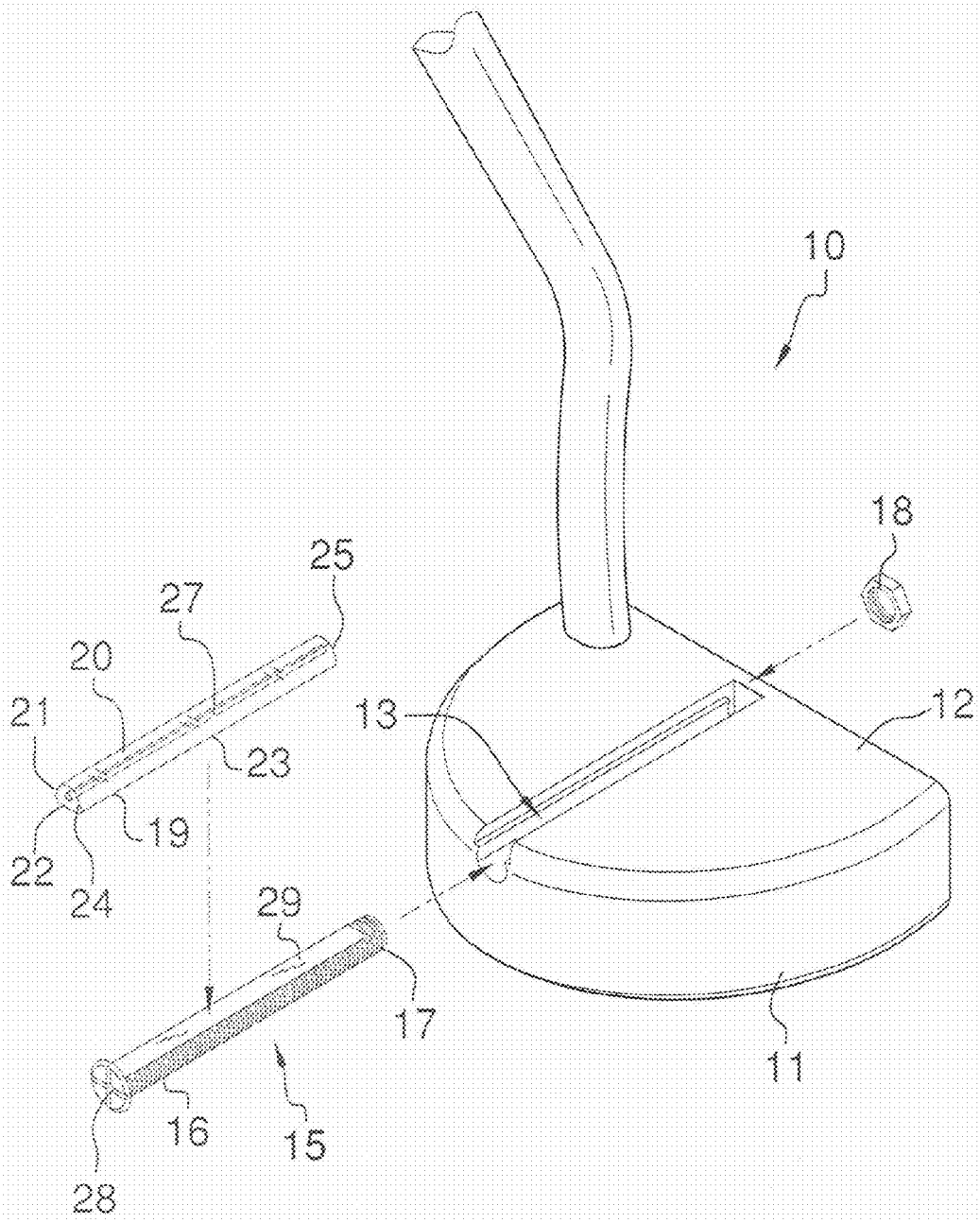
FIG. 2 is a top exploded perspective view of the present invention.
Figure 3:
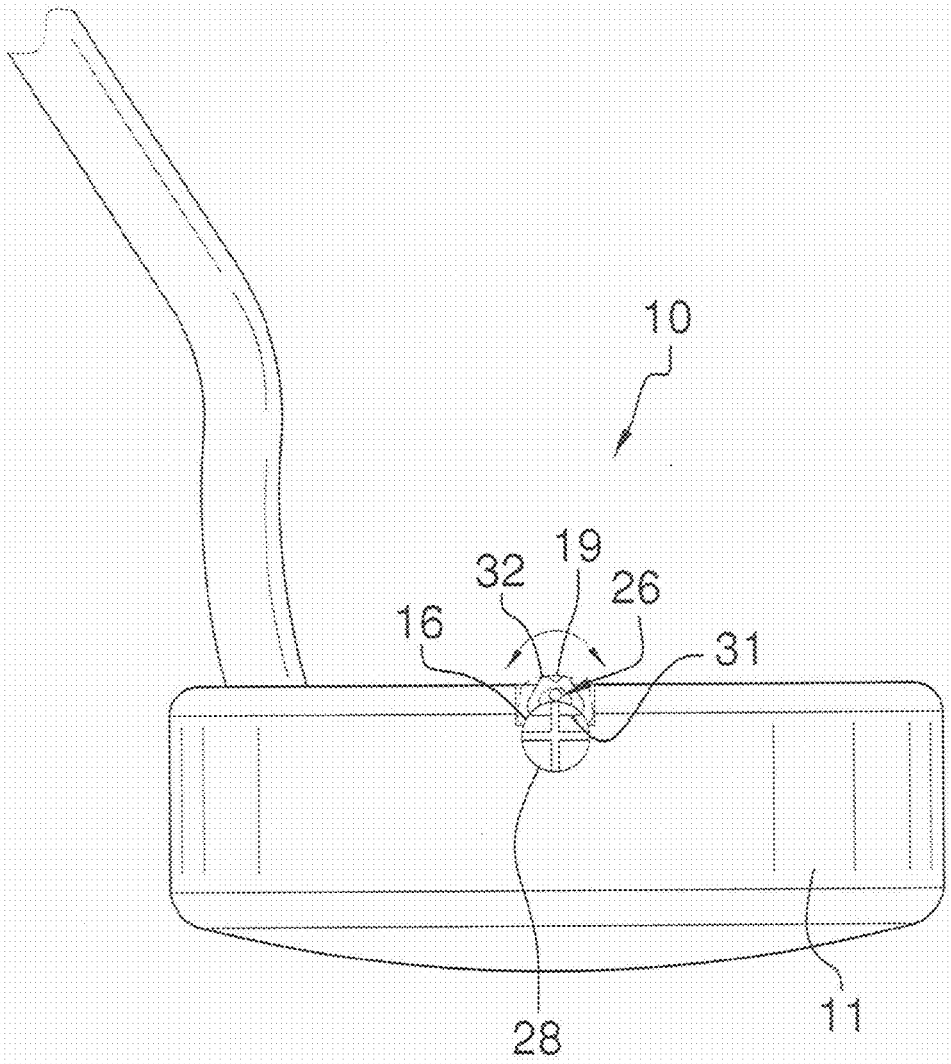
FIG. 3 is a rear elevation view of the present invention with the dashed lines showing the pivoting of the alignment member of the present invention.

With reference now to the drawings, and in particular to FIGS. 1 through 3 thereof, a new visual adjustable alignment system embodying the principles and concepts of the present invention and generally designated by the reference numeral 10 will be described.

As best illustrated in FIGS. 1 through 3, the visual adjustable alignment system 10 generally may comprise an implement member 11 for performing a task, and may also comprise an adjustment assembly 15 in conventional communication with the implement member 11, and may further comprise an alignment member 19 pivotably and conventionally supported by the adjustment assembly 15 for aligning the implement member 11 relative to an object. The implement member 11 may be a solid body having a top side 12. The implement member 11 may have a channel 13 linearly disposed therein through the top side 12 thereof.

As shown in FIGS. 1 through 3, the adjustment assembly 15 may include an adjustment member 16 pivotably and conventionally disposed in the channel 13 and having an access end 28 for pivoting the adjustment member 16. The adjustment member 16 may also include a support member 18 conventionally disposed and seated in the channel 13 and engaged to the adjustment member 16 to secure the adjustment member 16 in the channel 13. The adjustment member 16 may be a fastener 16 having a threaded end portion 17 such as a bolt and the support member 18 may be a nut 18 threadable upon the end portion 17 of the fastener 16 with the fastener 16 further having a planar longitudinal side 29.

As illustrated in FIGS. 1 through 3, the alignment member 19 may be in communication with the top side 12 of the implement member 11. The alignment member 19 may be conventionally attached or adhered to and supported upon the adjustment member 16 and pivotable with the adjustment member 16. The alignment member 19 may be a transparent tubular member 19 having a plurality of longitudinal sides 20-23 including a window 20 forming one of the Longitudinal sides 20-23 with the longitudinal sides 20-23 angled relative to one another. The tubular member 19 also has a bore 26 longitudinally disposed therein and further has closed ends 24-25 with the bore 26 extending substantially along a length of the lobular member 19. The alignment member 19 may further include a colored material 27 disposed in and extending a length of the bore 26 with the colored material 27 forming a uniform line 27 and being visible through the window 20 of the tubular member 19. The colored material 27 may be a liquid 27. The window 20 through which the line 27 is visible may be planar. The window 20 may comprise a magnifying member 30 to magnify the colored material 27 forming the uniform line 27 to enhance visibility of the colored material 27 through the window 20 of the tubular member 19. The alignment member 19 may be pivotable clockwise and counter clockwise as viewed from the access end 28 of the alignment member 19 with the planar window 20 of the tubular member 19 being disposed either parallel to or angled relative to the top side 12 of the solid body 11 with a line of sight of a user being directly above or to either side of the tubular member 19.

As shown in FIGS. 1 through 3, the solid body 11 may be a golf putter head 11 having a planar ball-hitting face 14 with the top side 32 of the golf putter head 11 and the channel 13 linearly disposed perpendicular to the planar ball-hitting face 14. The line 27 may be disposed perpendicular to the ball-hitting face 14 of the golf putter head 11. The tubular member 19 may have a lower longitudinal portion 31 disposed below the top side 12 of the golf putter head 11 and an upper longitudinal portion 32 disposed above the top side 12 of the golf putter head 11.

In use, the user may position the implement member 11 in relationship to an object with the user then adjusting the alignment member 19. The user may pivot the alignment member 19 relative to the implement member 11 with the line 27 in the alignment member 19 being in a line of sight of a user and visible through the window 20 of the alignment member 19 and linearly aligned with the object. The user may then align the implement member 11 relative to the object using the alignment member 19. A golfer's line of sight may be directly above the alignment member 19 thus the alignment member 19 may be pivoted such that the window 20 of the alignment member 19 may be parallel to the top side 12 of the golf putter head. Another golfer's line of sight may be to a side of the putter head 11 closest to the user and thus the alignment member 19 may be pivoted with the window 20 of the alignment member 19 positioned towards the user. Yet, another golfer's line of sight may be to a side of the putter head 11 farthest from the user and thus the alignment member 19 may be pivoted with the window 20 of the alignment member 19 positioned away from the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the visual adjustable alignment system. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

I claim:

1. A visual adjustable alignment system comprising:

an implement member for performing a task, wherein the implement member is a solid body having a top side, wherein the implement member has a channel linearly disposed in the top side thereof;

an adjustment assembly in communication with the implement member, wherein the adjustment assembly includes an adjustment member pivotably disposed in the channel and having an access end for pivoting the adjustment member; and an alignment member pivotably supported by the adjustment assembly for aligning the implement member relative to an object, wherein the alignment member is attached to and supported upon the adjustment member and pivotable with the adjustment member, wherein the alignment member is a transparent tubular member having a plurality of longitudinal sides including a window forming one of the longitudinal sides with the longitudinal sides angled relative to one another, wherein the tubular member also has a bore longitudinally disposed therein and further has closed ends with the bore extending substantially along a length of the tubular member.

2. The visual adjustable alignment system as described in claim 1, wherein the alignment member further includes a colored material disposed in and extending a length of the bore with the colored material forming a uniform line and being visible through the window of the tubular member, wherein the window through which the line is visible is planar.

3. The visual adjustable alignment system as described in claim 2, wherein the colored material includes a liquid.

4. The visual adjustable alignment system as described in claim 2, wherein the window includes a magnifying member to magnify the colored material forming the uniform line to enhance visibility of the uniform line through the window.

5. The visual adjustable alignment system as described in claim 2, wherein the alignment member is pivotable clockwise and counter clockwise as viewed from the access end of the alignment member with the window being disposed either parallel to or angled relative to the top side of the implement member to view the line directly above or to either side of the tubular member.

6. The visual adjustable alignment system as described in claim 5, wherein the implement member is a golf putter head having a planar ball hitting face with the top side of the golf putter head and the channel linearly disposed perpendicular to the ball hitting face.

7. The visual adjustable alignment system as described in claim 6, wherein the line in the alignment member is disposed perpendicular to the planar ball hitting face of the golf putter head.

8. The visual adjustable alignment system as described in claim 6, wherein the tubular member has a lower longitudinal portion disposed below the top side of the golf putter head and an upper longitudinal portion disposed above the top side of the golf putter head.

* * * * *